US010239118B2

(12) United States Patent
Gotlund et al.

(10) Patent No.: US 10,239,118 B2
(45) Date of Patent: Mar. 26, 2019

(54) SIDE FRAME CENTER CORE CONSTRUCTION AND METHOD

(71) Applicant: Nevis Industries LLC, Wilmington, DE (US)

(72) Inventors: Erik L. Gotlund, Green Oaks, IL (US); Roshan N. Manibharathi, Des Plaines, IL (US)

(73) Assignee: Nevis Industries LLC, Wilmington, DE (US)

( * ) Notice: Subject to any disclaimer, the term of this patent is extended or adjusted under 35 U.S.C. 154(b) by 267 days.

(21) Appl. No.: 15/224,027

(22) Filed: Jul. 29, 2016

(65) Prior Publication Data

US 2018/0029109 A1 Feb. 1, 2018

(51) Int. Cl.

| | |
|---|---|
| ***B22C 9/10*** | (2006.01) |
| ***B22C 9/22*** | (2006.01) |
| ***B22C 9/24*** | (2006.01) |
| ***B22C 9/02*** | (2006.01) |
| ***B22C 9/08*** | (2006.01) |
| ***B22C 21/14*** | (2006.01) |
| ***B61F 5/52*** | (2006.01) |

(52) U.S. Cl.

CPC ..... *B22C 9/108* (2013.01); *B22C 9/02* (2013.01); *B22C 9/082* (2013.01); *B22C 9/088* (2013.01); *B22C 9/103* (2013.01); *B22C 9/22* (2013.01); *B22C 9/24* (2013.01); *B22C 21/14* (2013.01); *B61F 5/52* (2013.01)

(58) Field of Classification Search

CPC ..... B22C 9/10; B22C 9/103; B22C 9/108; B22C 9/22; B22C 9/24

See application file for complete search history.

(56) References Cited

U.S. PATENT DOCUMENTS

| | | | | |
|---|---|---|---|---|
| 1,746,301 | A * | 2/1930 | Bettendorf | B22C 9/22 164/340 |
| 2,699,002 | A | 1/1955 | Sylvestro | |
| 4,156,450 | A | 5/1979 | Hunter | |
| 5,752,564 | A * | 5/1998 | Callahan | B22C 9/103 164/137 |
| 8,186,420 | B2 | 5/2012 | Filip et al. | |
| 8,672,152 | B2 | 3/2014 | Nibouar et al. | |

(Continued)

FOREIGN PATENT DOCUMENTS

| | | |
|---|---|---|
| CN | 201217069 Y | 4/2009 |
| CN | 202683953 U | 1/2013 |
| EP | 0852975 A1 | 7/1998 |

OTHER PUBLICATIONS

Oct. 23, 2017—(WO) International Search Report and Written Opiniion—App. PCT/US2017/044449.

*Primary Examiner* — Kevin E Yoon
(74) *Attorney, Agent, or Firm* — Banner & Witcoff, Ltd.

(57) ABSTRACT

A side frame may include a bolster opening configured to receive an outbound portion of a bolster. A center core may be used during the manufacture of the side frame to form the bolster opening. The center core may include first and second side walls configured to form the first and second side frame columns of the bolster opening. Additionally, each of the first side wall and second side wall may include one or more pin core holes each of which is configured to receive a pin core used in forming the fastening holes of the first and second side frame columns.

15 Claims, 12 Drawing Sheets

(56) References Cited

U.S. PATENT DOCUMENTS

| | | | | |
|---|---|---|---|---|
| 8,770,265 | B2 | 7/2014 | Nibouar et al. | |
| 8,813,810 | B1 * | 8/2014 | Bauer | B22C 9/22 164/202 |
| 9,216,450 | B2 | 12/2015 | Gotlund et al. | |
| 9,233,416 | B2 | 1/2016 | Gotlund et al. | |
| 2012/0175905 | A1 | 7/2012 | Mautino et al. | |
| 2012/0291662 | A1 | 11/2012 | Gotlund et al. | |
| 2012/0291976 | A1 | 11/2012 | Gotlund et al. | |
| 2012/0291977 | A1 | 11/2012 | Gotlund et al. | |
| 2013/0025811 | A1 | 1/2013 | Nibouar et al. | |
| 2013/0025815 | A1 | 1/2013 | Nibouar et al. | |
| 2013/0168035 | A1 | 7/2013 | Nibouar et al. | |

* cited by examiner

SIDE FRAME CENTER CORE CONSTRUCTION AND METHOD

FIELD

Aspects described herein generally relate to the side frames for railway trucks and fabrication of side frames. More specifically, aspects relate to center core construction and implementation in the fabrication of railway truck side frames.

BACKGROUND

Railway cars typically consist of a rail car that rests upon a pair of truck assemblies. The truck assemblies include a pair of side frames and wheelsets connected together via a bolster and damping system. The car rests upon the center bowl of the bolster, which acts as a point of rotation for the truck system. The car body movements are reacted through the springs and friction wedge dampers, which connect the bolster and side frames. The side frames include pedestals that each define a jaw into which a wheel assembly of a wheel set is positioned using a roller bearing adapter. Additionally, the side frames include bolster openings through which the bolster, and the springs and friction wedge dampers attached thereto, are assembled into.

The side frames may be formed via various casting techniques. The most common technique for producing these components is through sand casting. Sand casting offers a low cost, high production method for forming complex hollow shapes such as a side frame. In a typical sand casting operation, (1) a mold is formed by packing sand around a pattern, which generally includes the gating system; (2) The pattern is removed from the mold; (3) cores, which may form the interior cavity or profile of the casting, may be formed separately and then placed into the mold, which is then closed; (4) the mold is filled with hot liquid metal through the gating; (5) the metal is allowed to cool in the mold; (6) the solidified metal referred to as raw casting is removed by breaking away the mold and/or sand mold cores; (7) and the casting is finished and cleaned which may include the use of grinders, welders, heat treatment, shot blasting, and machining.

In a sand casting operation, the mold is created using sand as a base material, mixed with a binder to retain the shape. The mold is created in two halves—cope (top) and drag (bottom) which are separated along the parting line. The sand is packed around the pattern and retains the shape of the pattern after the pattern is extracted from the mold. Draft angles of 3 degrees or more are machined into the pattern to ensure the pattern releases from the mold during extraction. In some sand casting operations, a flask is used to support the sand during the molding process through the pouring process.

The mold typically contains the gating system which provides a path for the molten metal, and controls the flow of metal into the cavity. This gating consists of a sprue, which controls metal flow velocity, and connects to the runners. The runners are channels for metal to flow through the gates into the cavity. The gates control flow rates into the cavity, and prevent turbulence of the liquid.

After the metal has been poured into the mold, the casting cools and shrinks as it approaches a solid state. As the metal shrinks, additional liquid metal must continue to feed the areas that contract, or voids will be present in the final part. In areas of high contraction, risers are placed in the mold to provide a secondary reservoir to be filled during pouring.

These risers are the last areas to solidify, and thereby allow the contents to remain in the liquid state longer than the cavity of the part being cast. As the contents of the cavity cool, the risers feed the areas of contraction, ensuring a solid final casting is produced. Risers that are open on the top of the cope mold can also act as vents for gases to escape during pouring and cooling.

When casting a complex or hollow part, cores are used to define the hollow interior portions, or complex sections that cannot otherwise be created with the pattern. These cores are typically created by molding sand and binder in a box shaped as the feature being created with the core. These core boxes are either manually packed or created using a core blower. The cores are removed from the box, and placed into the mold. The cores are located in the mold using core prints to guide the placement, and prevent the core from shifting while the metal is poured. Additionally, chaplets may be used to support or restrain the movement of cores, and fuse into the base metal during solidification.

In side frame casting operations, multiple cores are used to aid in the formation of the structure of the frame. Traditionally, the mold of the side frame is fitted with a pair of pedestal & window cores, a lower tension member core, a pair of inner jaw cores, and a bolster core or bolster opening core including a spring seat core and a plurality of pin cores. The cores serve to provide structure in the formation of aspects of the frame including the bolster opening, compression member, spring seat, pedestal jaws, and so on.

While the usage of multiple cores is commonplace in side frame fabrication, the number of cores used increases the complexities of the manufacturing process, probability of manufacturing defects, and overall costs of production.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Aspects of the disclosure are directed to center core construction and implementation in the fabrication of railway truck side frames. In certain examples a center core for manufacturing a side frame of a rail car, where the side frame includes a bolster opening configured to receive an outboard end of a bolster is disclosed. The center core may include a first side wall having an inside surface and an outside surface; a second side wall having an inside surface and an outside surface; a top wall having an inside surface and an outside surface; and a bottom wall having an inside surface and an outside surface; wherein the outside surfaces of the first side wall, the second side wall, the top wall and the bottom wall define the bolster opening; wherein the inside surfaces of the first side wall, the second side wall, the top wall and the bottom wall define at least one aperture; and wherein the first side wall includes at least one aperture configured to accept a pin core, and wherein the second side wall includes at least one aperture configured to accept a second pin core.

The center core may include a center column located between the first side wall and the second side wall. The center column may be substantially parallel with the first side wall and with the second side wall. The center column may be substantially centered between the first side wall and the second side wall.

The first side wall may include two apertures configured to accept the first pin core and a third pin core, and the second side wall may include two apertures configured to accept the second pin core and a fourth pin core.

In another example the disclosure provides a system for manufacturing a side frame of a rail car, where the side frame includes a bolster opening configured to receive an outboard end of a bolster. The system may include a center core comprising: a first side wall having an inside surface and an outside surface and having at least one aperture passing between the inside surface and the outside surface; a second side wall having an inside surface and an outside surface and having at least one aperture passing between the inside surface and the outside surface; a top wall having an inside surface and an outside surface; a bottom wall having an inside surface and an outside surface; at least a first pin core configured to engage the at least one aperture in the first side wall; and at least a second pin core configured to engage the at least one aperture in the second side wall. The outside surfaces of the first side wall, the second side wall, the top wall and the bottom wall may define the bolster opening; and the inside surfaces of the first side wall, the second side wall, the top wall and the bottom wall may define at least one hollow volume. Each of the first and second pin cores may also be engaged with a core adjacent to the center core.

The system may also include a center column located between the first side wall and the second side wall. The center column may be substantially parallel with the first side wall and with the second side wall. The center column may be substantially centered between the first side wall and the second side wall.

The system may also include a first aperture in the first side wall passing between the inside surface and the outside surface of the first side wall; a second aperture in the first side wall passing between the inside surface and the outside surface of the first side wall; a third aperture in the second side wall passing between the inside surface and the outside surface of the second side wall; a fourth aperture in the second side wall passing between the inside surface and the outside surface of the second side wall; a first pin core engaged with the first aperture; a second pin core engaged with the second aperture; a third pin core engaged with the third aperture; and a fourth pin core engaged with the fourth aperture.

The first and second pin cores may be substantially cylindrically shaped. The first and second pin cores may each include a center core engagement portion configured to engage the center core; a fastening hole portion configured to form a fastening hole in a finished side frame; and an adjacent core engagement portion configured to engage a core adjacent the center core.

The center core engagement portion and the adjacent core engagement portion may be substantially frustoconically shaped. The fastening hole portion may be substantially cylindrically shaped.

The first and second pin cores may each include at least one alignment feature. The alignment feature may include a first side ridge; a second side ridge; and a bottom ridge.

In another example, the disclosure provides, a method for manufacturing a side frame of a rail car, where the side frame includes a bolster opening configured to receive an outboard end of a bolster. The method includes providing a first portion of a mold; inserting a center core in the first portion of the mold, the center core comprising: a first side wall having an inside surface and an outside surface and having at least one aperture passing between the inside surface and the outside surface; a second side wall having an inside surface and an outside surface and having at least one aperture passing between the inside surface and the outside surface; a top wall having an inside surface and an outside surface; a bottom wall having an inside surface and an outside surface, wherein outside surfaces of the first side wall, the second side wall, the top wall and the bottom wall define the bolster opening; and wherein the inside surfaces of the first side wall, the second side wall, the top wall and the bottom wall define at least one hollow volume; inserting a first pin core through the at least one hollow volume into the at least one aperture in the first side wall and engaging the first pin core with a core adjacent to the center core; and inserting a second pin core through the at least one hollow volume into the at least one aperture in the second side wall and engaging the second pin core with a core adjacent to the center core.

The method may also include inserting a third pin core through the at least one hollow volume into a third aperture in the first side wall; and inserting a fourth pin core through the at least one hollow volume into a fourth aperture in the second side wall. The method may also include aligning an alignment feature of each of the pin cores with an alignment feature of each of the respective apertures. The method may also include securing each of the pin cores into the respective aperture by using adhesive. The method may also include securing each of the pin cores into the respective aperture by packing sand adjacent a distal end of each of the pin cores.

BRIEF DESCRIPTION OF THE DRAWINGS

A more complete understanding of aspects described herein and the advantages thereof may be acquired by referring to the following description in consideration of the accompanying drawings, in which like reference numbers indicate like features, and wherein.

DETAILED DESCRIPTION

In the following description of the various embodiments, reference is made to the accompanying drawings, which form a part hereof, and in which is shown by way of illustration various embodiments in which aspects described herein may be practiced. It is to be understood that other embodiments may be utilized and structural and functional modifications may be made without departing from the scope of the described aspects and embodiments. Aspects described herein are capable of other embodiments and of being practiced or being carried out in various ways. Also, it is to be understood that the phraseology and terminology used herein are for the purpose of description and should not be regarded as limiting. Rather, the phrases and terms used herein are to be given their broadest interpretation and meaning. The use of "including" and "comprising" and variations thereof is meant to encompass the items listed thereafter and equivalents thereof as well as additional items and equivalents thereof. The use of the terms "mounted," "connected," "coupled," "positioned," "engaged" and similar terms, is meant to include both direct and indirect mounting, connecting, coupling, positioning and engaging.

Also, while the terms "top," "bottom," "front," "back," "side," "rear," "upward," "downward," and the like may be used in this specification to describe various example features and elements of the disclosure, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this disclosure. Also, the reader is advised that the attached drawings are not necessarily drawn to scale.

Figure 1A:
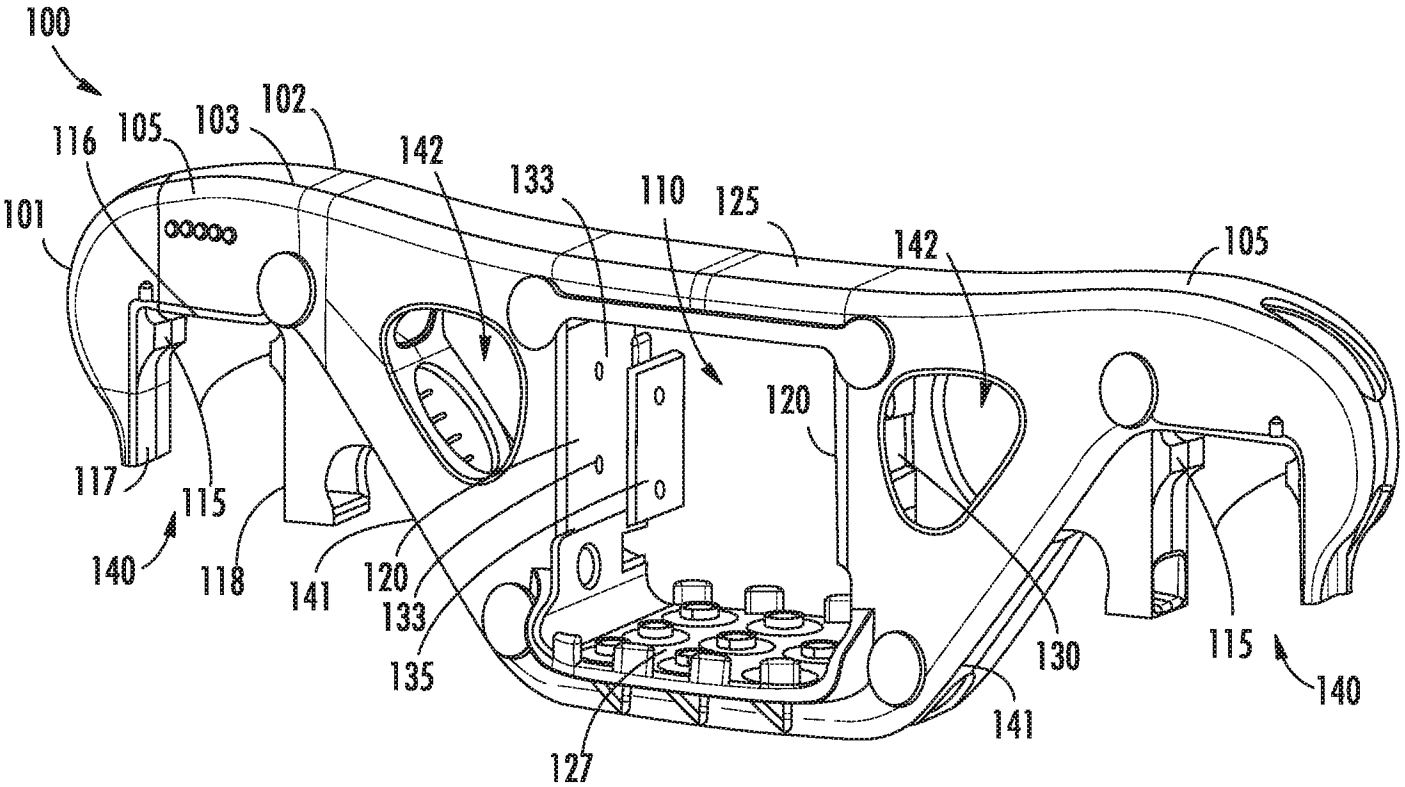
FIGS. 1A and 1B illustrate a prospective and side view, respectively, of an exemplary side frame of a railway car truck according to one or more aspects of the disclosure.
Figure 1B:
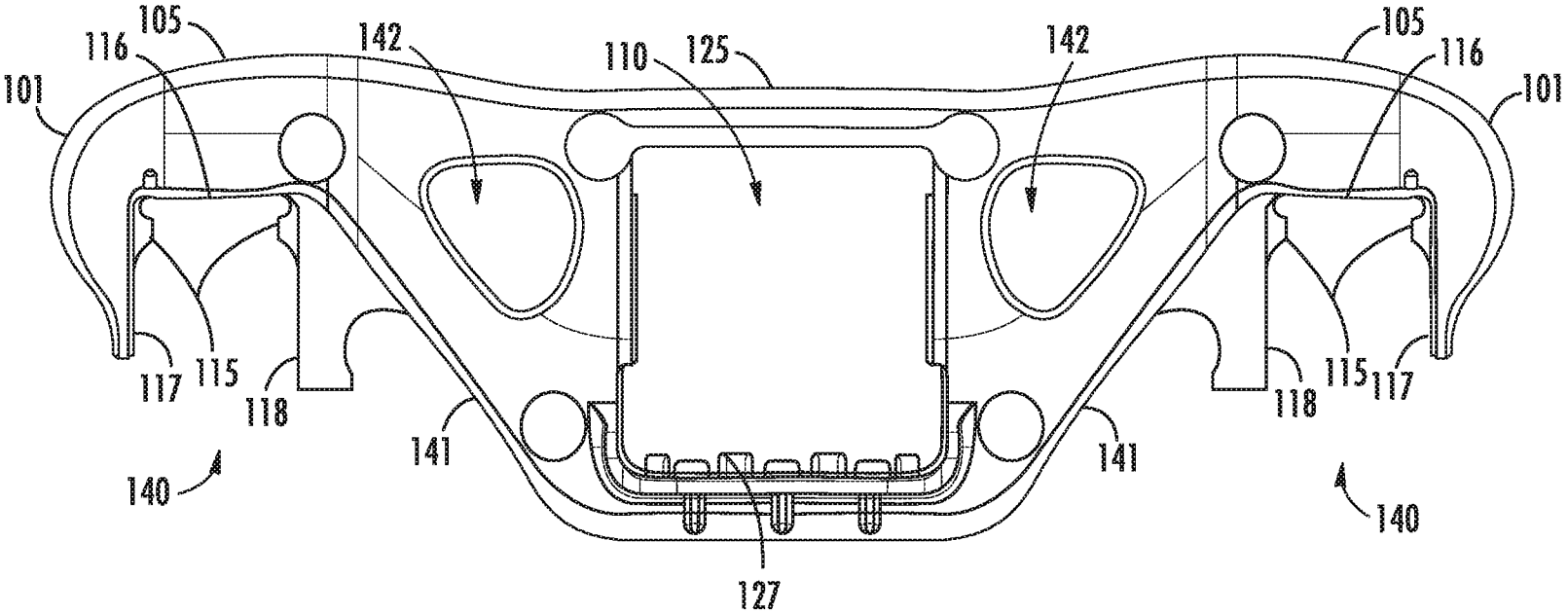

FIG. 1A illustrates a perspective view of a side frame 100 of a railway car truck. The railway car may correspond to a freight car, such as those utilized in the United States for carrying cargo in excess of 220,000 lbs. Gross Rail Load. The side frame 100 may include pedestals 105 and bolster opening 110.

Figure 2A:
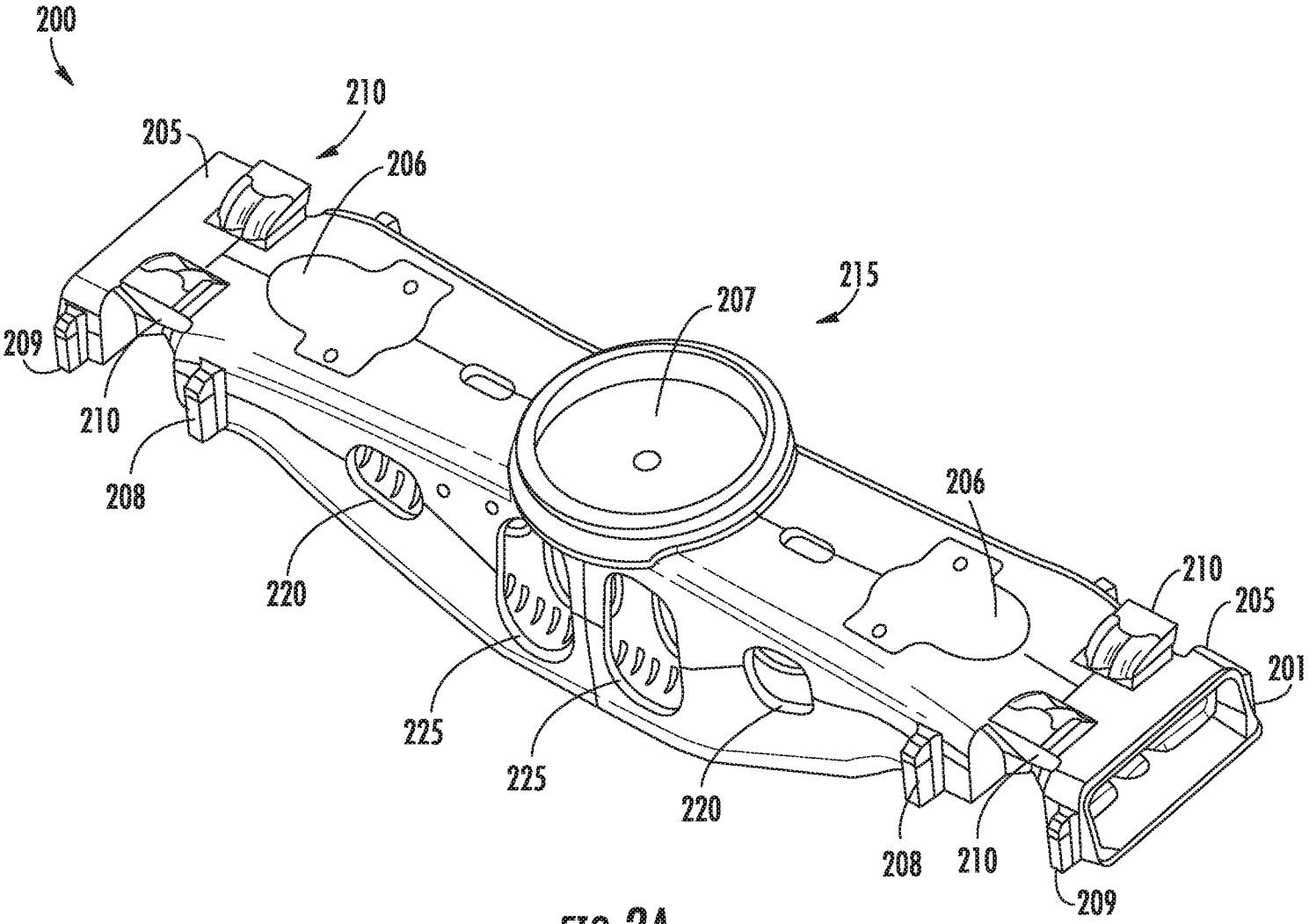
FIGS. 2A and 2B illustrate a prospective and side view, respectively, of an exemplary bolster of a railway car truck according to one or more aspects of the disclosure.
Figure 2B:
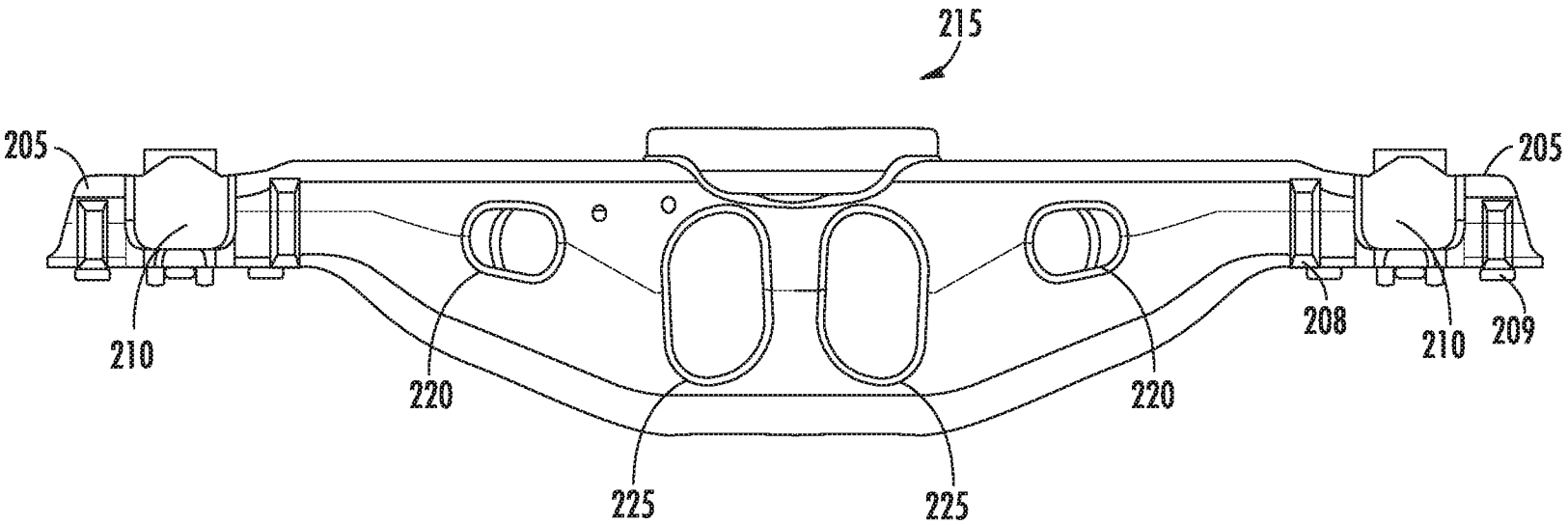

The bolster opening 110 may be defined by a pair of side frame columns 120, a compression member 125, and a spring seat 127. The bolster opening 110 may be sized to receive an outboard end section 205 of a bolster 200 (FIGS. 2A & 2B). A group of springs (not shown) may be positioned between the outboard end sections 205 of the bolster 200 and the spring seat 127 of side frame 100. The springs may be used to resiliently couple the bolster 200 to the side frame 100.

A pair of wear plates 135 and a pair of wedges (not shown) may be positioned between shoe pockets 210 of the outboard end sections 205 of the bolster 200 and the side frame columns 120. The side frame columns 120 may include one or more fastening holes 133 configured to receive fasteners to attach the the wear plates 135 to the side frame columns 120 A single exemplary wear plate 135 is illustrated in FIG. 1A in a detached mode for illustrative purposes. The wear plates 135 and friction wedges (not shown) function as shock absorbers that prevent sustained oscillation between the side frame 100 and the bolster 200. Each wear plate 135 may be made of metal. The wear plates 135 are configured to be attached to a side of the side frame column 120 that faces the bolster 200 (i.e., the bolster side of the side frame column 120). The wear plates 135 may be attached via welding and/or fasteners such as a bolt or a bolt and nut assembly that enables removal of wear plates 135. The fasteners may be accessible through either the bolster opening 110 and/or the column windows 142.

Returning to FIG. 1A, each pedestal 105 defines a pedestal jaw 140 into which a wheel assembly from a wheel set of the truck is mounted. In particular, each pedestal jaw 140 may include a pedestal roof 116, an outboard vertical jaw 117, an inboard vertical jaw 118, and inboard and outboard contact surfaces 115 known as thrust lugs that are in direct contact with complementary surfaces of the adapter and wheel assemblies. The contact surfaces 115 determine the alignment of the wheel assemblies within the pedestal jaws 140. To provide correct alignment, the contact surfaces 115 may be cleaned during a finishing process to remove imperfections left over from the casting process.

Figure 3:
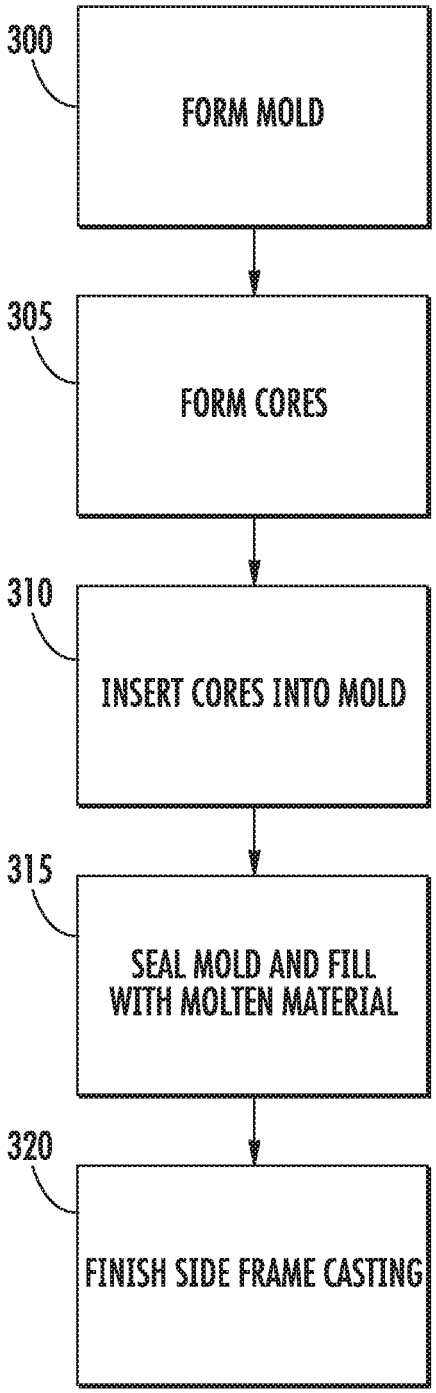
FIG. 3 depicts an illustrative method for manufacturing a side frame according to one or more aspects of the disclosure.
Figure 4:
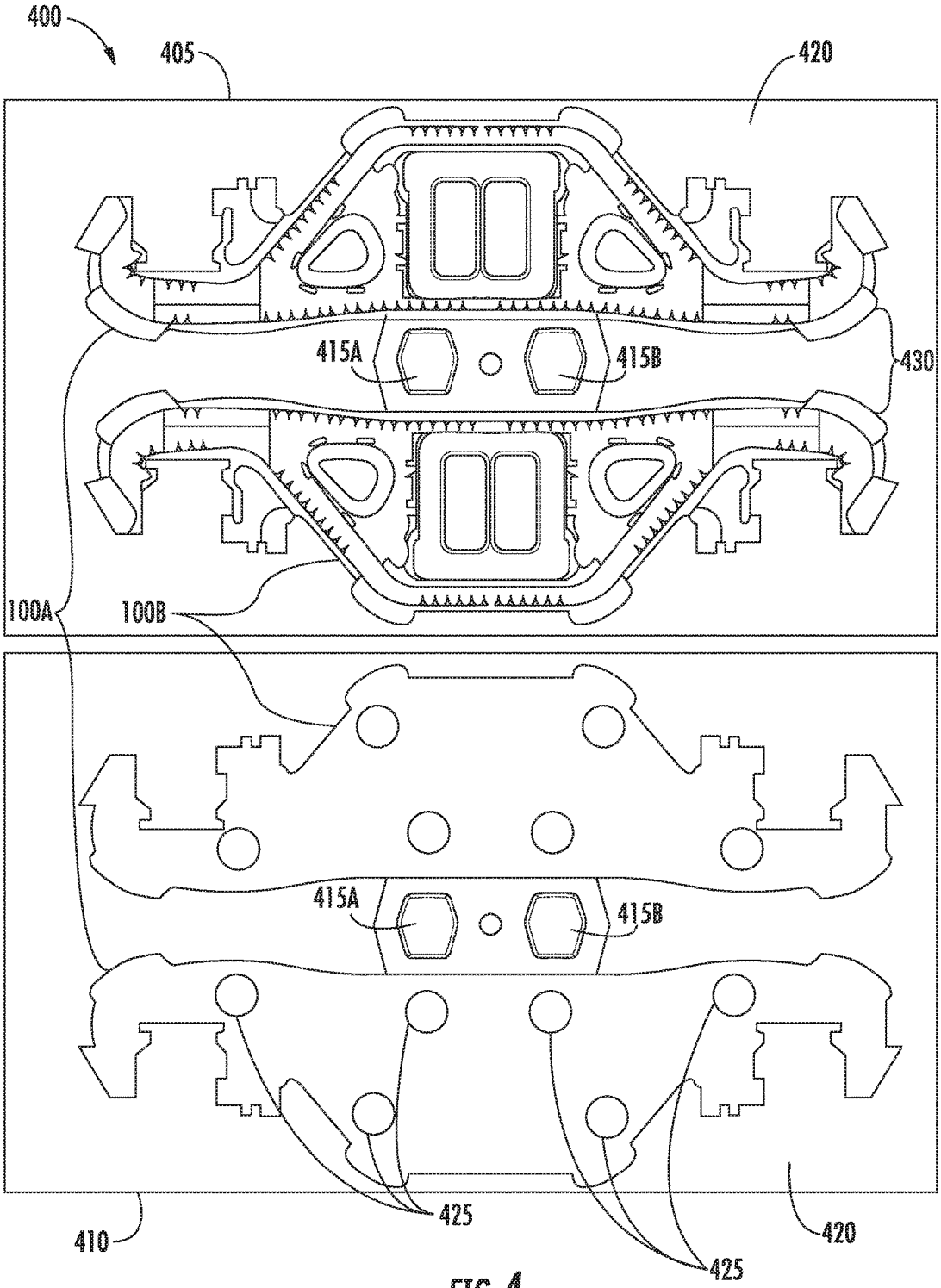
FIG. 4 illustrates exemplary drag and cope portions of a mold for forming a side frame according to one or more aspects of the disclosure.

FIG. 3 illustrates an exemplary method for manufacturing the side frame 100 described above. The operations are better understood with reference to FIG. 4. At block 300, a mold 400 for manufacturing one or more side frames 100 may be formed. Referring to FIG. 4, the mold 400 may include a first portion or drag portion 405 and a second portion or cope portion 410, and, in one example, may be configured to form a first side frame 100A and a second side frame 100B. The drag portion 405 of the mold 400 includes cavities formed in the shape of the drag side 102 of the side frames 100A and 100B. The cope portion 410 includes cavities formed in the shape of the cope side 103 of the side frames 100A and 100B. In other instances, the mold 400 may be configured to form a single side frame 100. In such instances, the first portion or drag portion 405 may include a cavity in the shape of the drag side 102 of the side frame 100, and the second portion or cope portion 410 may include a cavity in the shape of the cope side 103 of side frame 100.

The mold may be formed by providing patterns (not shown) that define features of the drag side 102 and cope side 103, respectively, of the first side frame 100A and the second side frame 100B. The patterns may additionally define one or more gates 415A and 415B for distribution of molten material within the mold 400. The one or more gates 415A/415B may be positioned in a center region of the mold 400 in between the first side frame 100A and the second side frame 100B to provide for an even distribution of the molten material throughout the mold 400 during casting. For example, gates 415A/415B may be positioned in an area of the mold 400 bordering the compressive member 125 of each of the side frames.

Additionally, one or more risers 425 may be inserted into the cope portion 410 of the mold 400. The risers 425 may be insulating hollow cylindrical structures into which molten material fills during casting operations. The risers 425 may be positioned at areas of the mold that correspond to thicker areas of the side frame that cool more slowly than other areas of the side frame. The risers 425 function as reservoirs of molten material that compensate for contraction that occurs in the molten material as the molten material cools, and thus prevent shrinkage, or hot tearing of the cast side frame in the thicker areas that might otherwise occur. In addition, risers which are open to atmosphere on top work with vents to allow air and mold gas to escape during pouring and filling.

Molding material 420 is then packed over and around the pattern and risers 425 until the mold is filled. The molding material 420 may correspond to a chemical or resin binder material such as phenolic urethane, rather than green-sand products utilized in known casting operations. The chemical binder material product enables forming molds with greater precision and finer details. The molding material 420 is then leveled off and cured to harden. The patterns are removed once the molding material 420 cures.

At block 305, one or more core assemblies 430 that define the interior region of the side frames 100A and 100B are formed. The core assemblies 430 may include a center core 500.

Figure 5A:
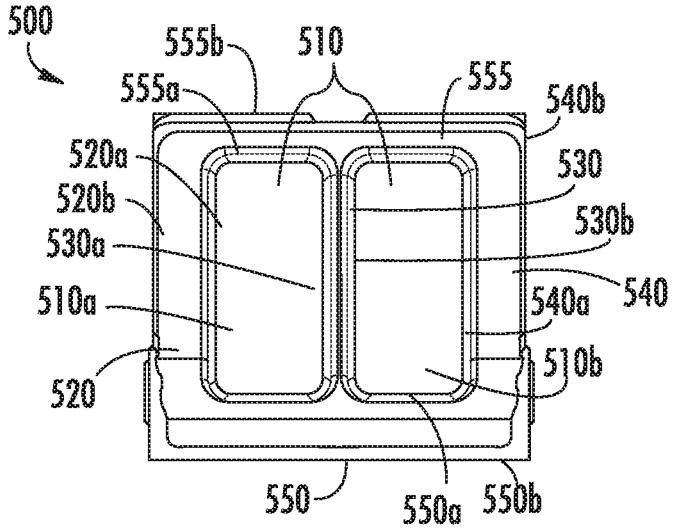
FIGS. 5A, 5B, and 5C may illustrate front, side, and bottom views, respectively, of an exemplary center core according to one or more aspects of the disclosure.
Figure 5B:
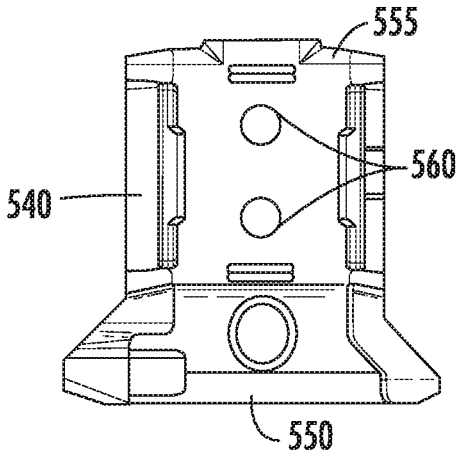
Figure 5C:
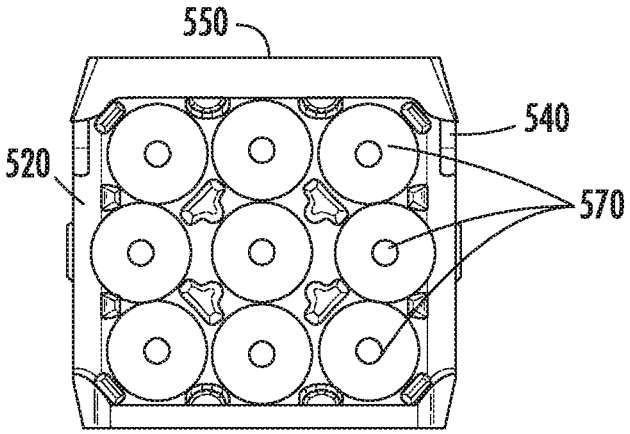
Figure 7:
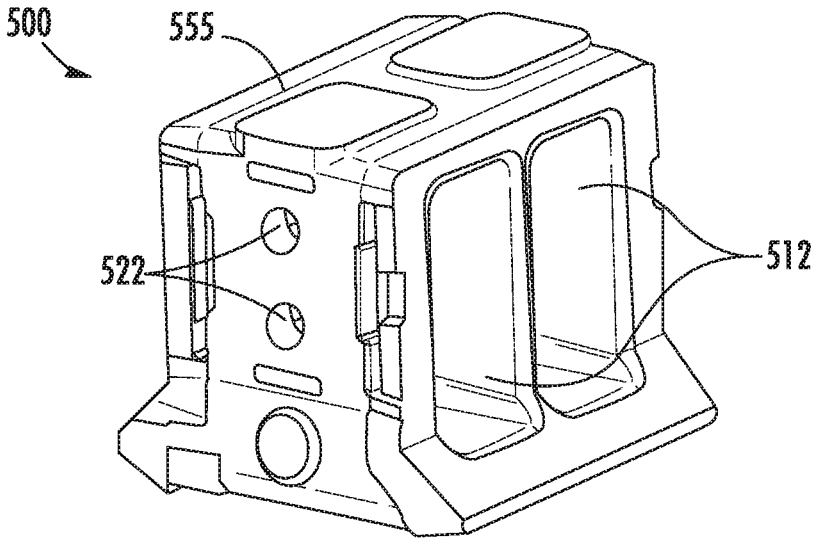
FIG. 7 illustrates a perspective view of an exemplary center core according to one or more aspects of the disclosure.

Front, bottom, and side views of center core (which may also be referred to as the bolster core or bolster opening core) 500 are depicted, respectively, in FIGS. 5A, 5B, and 5C, and a perspective view of center core 500 is depicted in FIG. 7. The center core 500 may be formed with a core blower and may be configured to be inserted into the first portion or drag portion 405 of mold 400. Center core 500 may spatially delineate the bolster opening 110 of side frame 100. The center core 500 may be fabricated in a single piece in instances when a core blower is used to form the core. In alternate embodiments, the center core 500 may be fabricated in two pieces (e.g., cope and drag pieces). After forming the two pieces, the pieces may then be adhesively joined together to form center core 500. In still other embodiments, the center core 500 may be fabricated of more than two pieces Regardless of the fabrication method used, center core 500 may include a first side wall 520, a second side wall 540, a bottom wall 550 and top wall 555. Each of the first side wall 520, second side wall 540, bottom wall 550, and top wall 555 may have an inner surface 520*a*, 540*a*, 550*a*, and 555*a* respectively and an outer surface 520*b*, 540*b*, 550*b*, and 555*b* respectively. The center core 500 may also include a center column 530 having a first surface 530*a* and a second surface 530*b*. One or more apertures or hollow center volumes 510 may be created in center core 500. In one embodiment, the center core 500 may include a first hollow center volume 510*a* located between the first side wall 520 and center column 530, and a second hollow center volume 510*b* location in between the second side wall 540 and center column 530. The first hollow center volume 510*a* may be defined by inner surfaces 520*a*, 555*a*, 530*a*, and 550*a*, and the second hollow center volume may be defined by inner surfaces 530*a*, 555*a*, 540*a*, and 550*a*. The outer surfaces 520*b*, 555*b*, 540*b*, and 550*b* may define the bolster opening 110. The outer surfaces 520*b* and 540*b* of the first side wall 520 and the second side wall 540 respectively may be configured to form the side frame columns 120 of the side frame 100.

Figure 10:
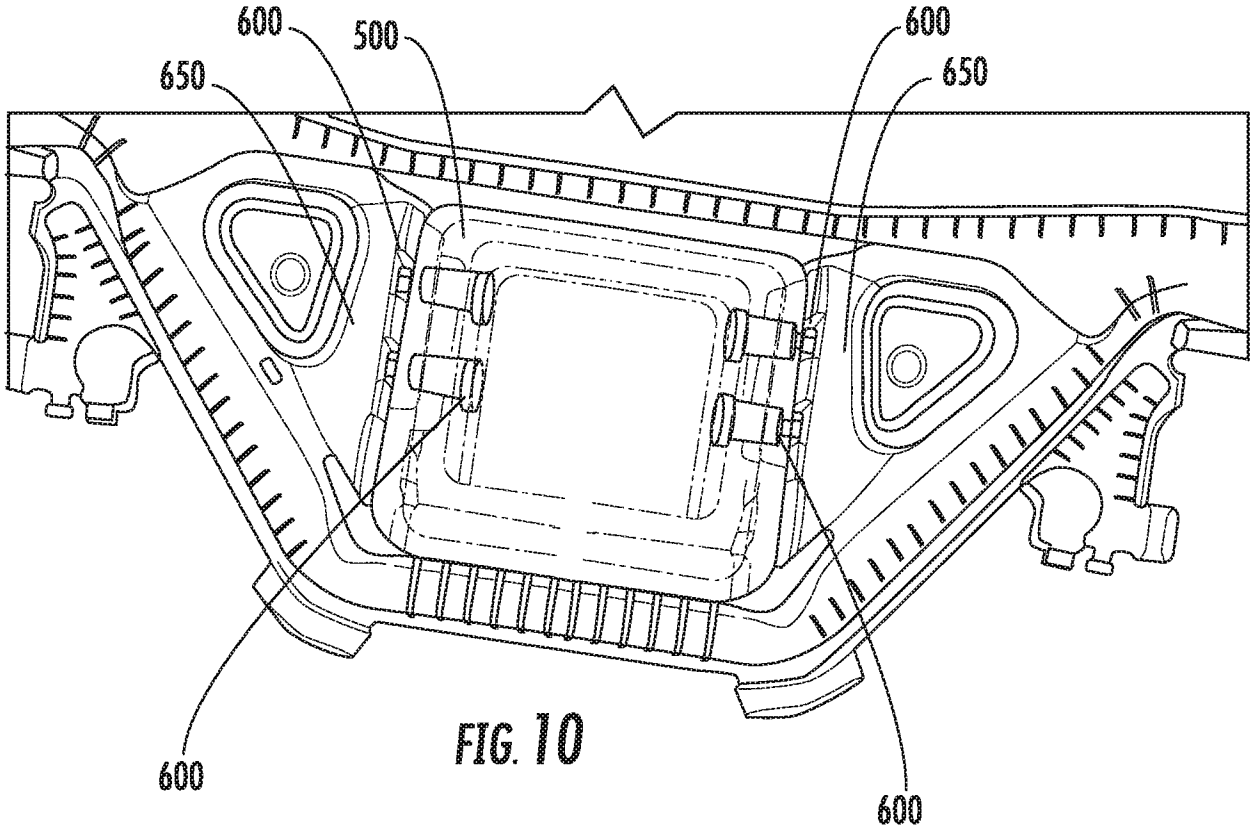
FIG. 10 illustrates a perspective view of cores used to form a side frame according to one or more aspects of the disclosure.

In alternate embodiments, as shown for example in FIG. 10, the center core 500 may be fabricated without center column 530. In such instances, a single hollow center column 510 may span from the first side wall 520 to the second side wall 540.

Each of the first side wall 520 and the second side wall 540 may include one or more apertures or pin core holes 560. The pin core holes 560 may extend through side walls 520 and 540. The pin core holes 560 may traverse the entirety of side walls 520 and 540 and may form openings on both inner (520*a*, 540*a*) and outer (520*b*, 540*b*) surfaces of the side walls 520, 540. Each of the one or more pin core holes 560 may be configured to receive or engage a pin core 600 through the inner surface 520*a*, 540*a* of the side walls 520 and 540.

Figure 6A:
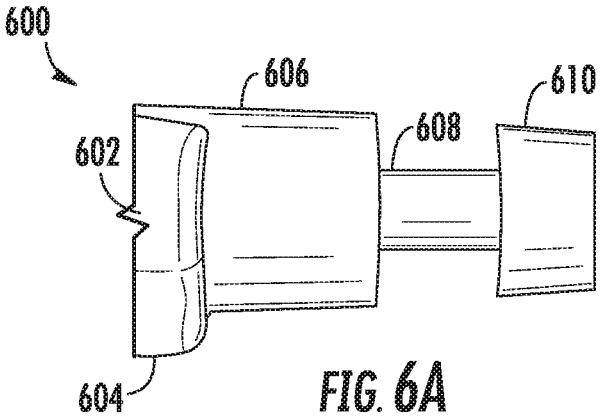
FIGS. 6A, 6B, and 6C illustrate front, side, and bottom views, respectively, of an exemplary pin core according to one or more aspects of the disclosure.
Figure 6B:
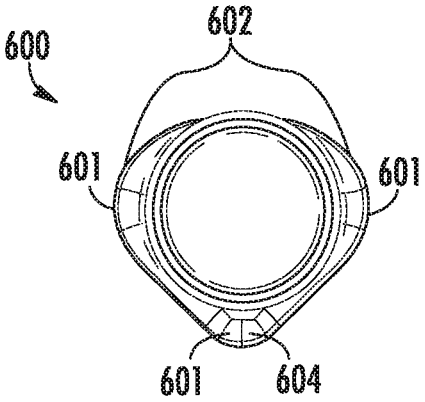
Figure 6C:
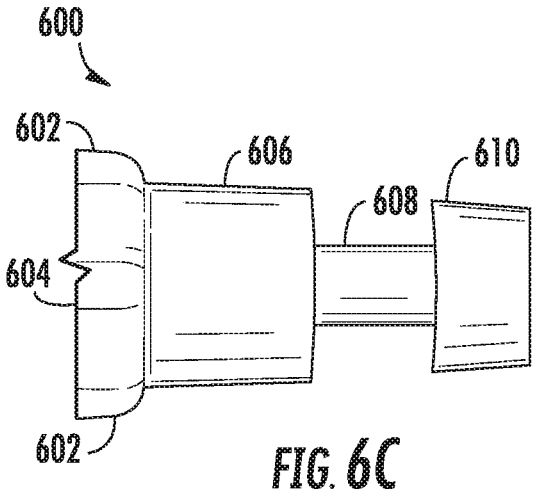
Figure 8:
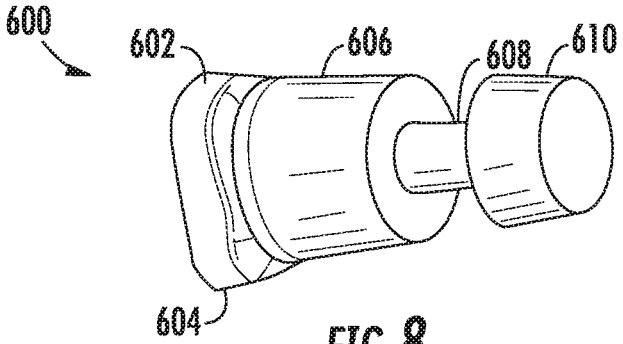
FIG. 8 illustrates a perspective view of an exemplary pin core according to one or more aspects of the disclosure.

Referring now to the pin core 600 in more detail, front, bottom, and side views of a pin core 600 are depicted, respectively, in FIGS. 6A, 6B, and 6C, and a perspective view of a pin core 600 is depicted in FIG. 8. As discussed above, the pin core 600 may be inserted through the hollow volume 510 and into pin core holes 560. The pin core 600 may include 3 general portions: a first portion or center core engagement portion 606; a second portion or fastening hole portion 608, and a third portion or adjacent core engagement portion 610.

Once the pin core 600 is inserted into the center core, the center core engagement portion 606 is configured to be located substantially adjacent the center core 500. The center core engagement portion 606 may be substantially cylindrical or in other embodiments may be tapered forming a frustoconical shape. Additionally, the center core engagement portion 606 may include one or more alignment features 601. The alignment features 601 may reduce incorrect insertion of the pin core 600 into the center core 500. As shown in FIGS. 6A-6C, the alignment features comprise two side ridges 602 and a bottom ridge 604. However, any number of different alignment features may be used without departing from this disclosure. As shown in FIGS. 6A-6C, and FIG. 8 the pin core 600 may include a plurality of side ridges 602, and a bottom ridge 604 which extend outward from the cylindrical or frustoconical shaped portion.

The fastening hole portion 608 extends from the center core engagement portion 606. The fastening hole portion is configured to form the fastening hole 133 in the side frame column 120 of the finished side frame 100. The fastening hole portion 608 may be substantially cylindrically shaped and may have a diameter of about 0.081 inches or greater than 0.75 inches.

The adjacent core engagement portion 610 extends from fastening hold portion 608. The adjacent core engagement portion 610 may be substantially cylindrical or as shown in FIGS. 6A-6C may be tapered forming a frustoconical shape. The adjacent core engagement portion 610 is configured to be inserted into an adjacent core which may act to hold the pin core 600 in place. The adjacent core engagement portion 610 may have an inward surface 611 which may be substantially flat and substantially circular or ring shaped. Thus, the inward surface 611 of the adjacent core engagement portion 610 may form a substantially flat and circular or ring shaped surface on the back side of the side frame column concentric to the bolt hole. Advantageously this may create a flat consistent surface for the column nut or washer to sit against, making for a more consistent bolted connection.

Figure 9:
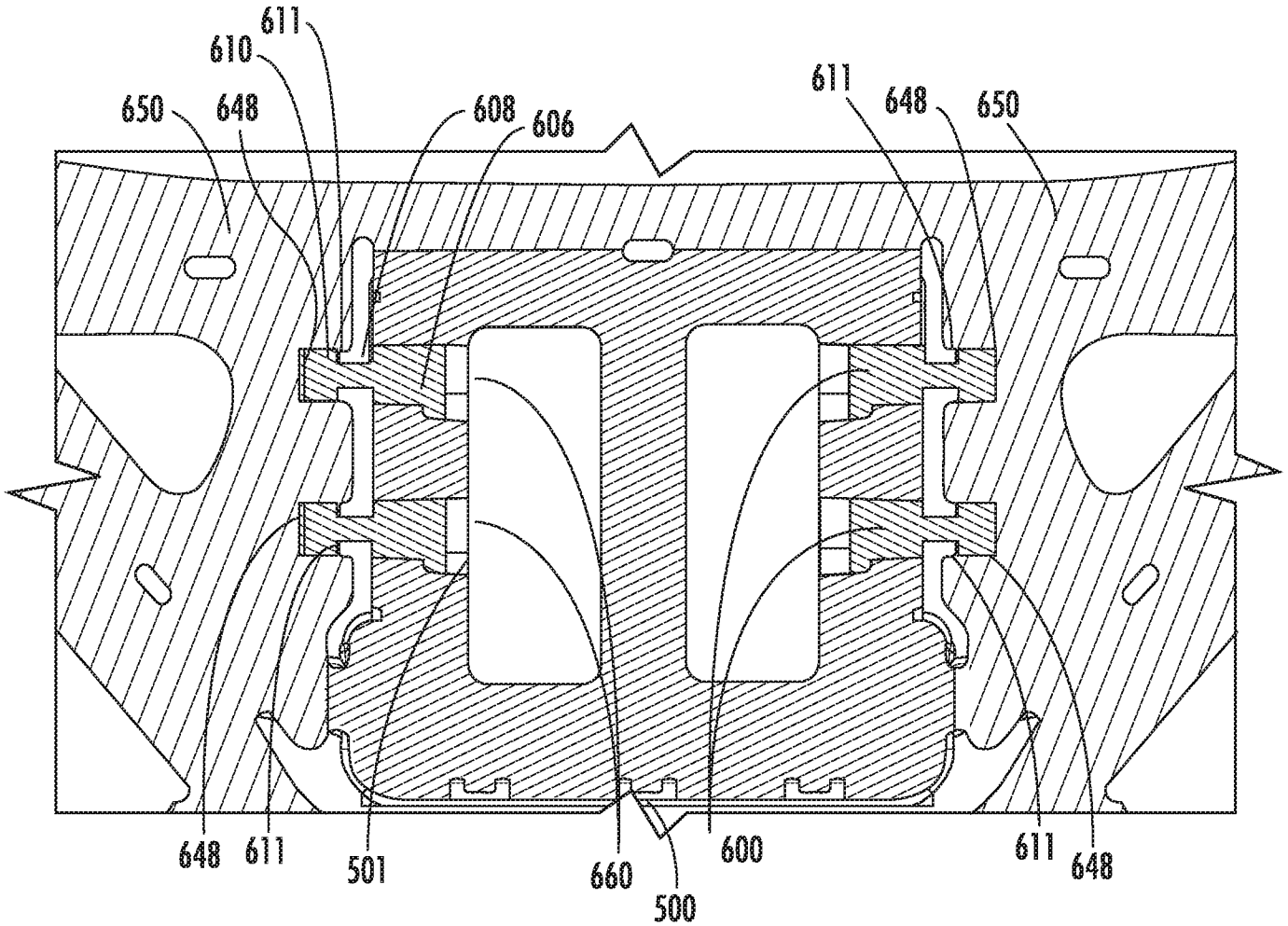
FIG. 9 illustrates a front cross-sectional view of the exemplary pin core inserted into an exemplary center core according to one or more aspects of the disclosure.

Referring now primarily to FIGS. 9 and 10 wherein pin cores 600 are shown inserted into the center core. As shown in FIGS. 9 and 10 the locating features 601 (plurality of side ridges 602 and bottom ridge 604) of the pin core 600 may be configured to be inserted into corresponding alignment features 501 on the center core 500. In some examples, the inner surfaces 520*a*, 530*a* of side walls 520 and 540 may include locating features 501 such as pin core slots sized correspondingly to the ridges 602 and 604. The pin core slots may be configured to interface with side ridges 602 and bottom ridge 604 of the respective pin core 600 inserted into the pin core hole 560. The pin core slots may serve to aide in the engagement of pin cores 600 into the pin core holes 560. As will be discussed below, once the pin cores 600 are in place, the pin cores 600 may be secured using adhesive, nails, and/or sand packed around a distal end of the pin core 600. Additionally, the pin cores may be aligned by the core print or indention 648 in the adjacent core 650. Advantageously the tapered or frustoconical shape of the adjacent core engagement portion 610 may prevent the pin core 600 from being inserted too far into the adjacent core 650.

In other alternate embodiments, on the inner face of the first side wall 520 and second side wall 540, the pin core holes 560 may include indexed pin core slots. The indexed pin core slots may be configured to rotatably receive the one or more pin cores 600 during the installation of the pin cores. Through the rotational insertion, the one or more pin cores 600 may become rigidly fastened into the pin core holes 560. In such instances, adhesive and sand packing may further be used, but are not necessary.

As shown primarily in FIG. 9, once pin core is placed within the pin hole 560, the a center core engagement portion 606 may be located adjacent the center core 500; the adjacent core engagement portion 610 may be located in an indention 648 in the adjacent core 650 which may be a pedestal & window core; and finally, the fastening hole portion 608 is located between the cores 500 and 650.

Figure 11:
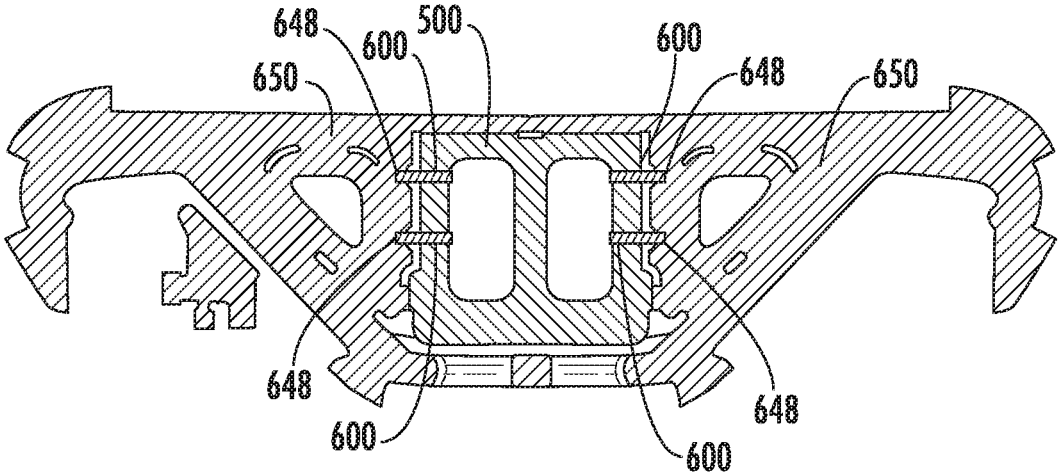
FIG. 11 illustrates a front cross-sectional view of an embodiment of an exemplary pin core inserted into an exemplary center core according to one or more aspects of the disclosure.

The pin cores 600 may have different shapes and/or sizes. For example, as shown in FIG. 11 the pin cores may be substantially cylindrical or rod shaped. Additionally, as shown in FIG. 11, one or more ends of the pin core 600 may be tapered.

Returning back to FIG. 3, and with reference to the center core 500 and pin cores 600 described herein, in block 310, the core assemblies 430 are inserted into the mold 400. The core assemblies 430 may be inserted into the first portion or drag portion 405 of the mold 400.

Once the center core 500 is placed in the mold, the pin cores 500 may then be inserted into the pin core holes 560 through the hollow volumes 510. In some embodiments, the pin cores 600 may be adhered to the center core 500 with an adhesive. The utilization of adhesive may prevent the one or more pin cores 600 from displacing, rotating, or otherwise being expelled from the pin core holes 560 during the pouring of the molten material into the mold 500. In some embodiments, after the pin cores 500 are installed in the pin core holes, sand may be packed over the pin core holes 560 to prevent the expulsion of the pin cores from the pin core holes 560 during the pouring of molten material into mold 500.

Once the cores are in place, the second portion or cope portion 410 may be placed over the drag portion 405 and secured to the drag portion 405 via clamps, straps, adhesive, or weights, and the like. In this regard, locating features may be formed in the drag portion 405 and the cope portion 410 to ensure precise alignment of the respective portions. Molten material, such as molten steel, may then be poured into the mold 400 via gates 415A and 415B at step 315. The molten material then flows through the mold 400 in the space between the mold 400 and the core assemblies 430. At block 320, the mold 400 is removed from the side frames 100A and 100B and the side frames are finished.

Advantageously, the one or more hollow center volumes 510, may provide advantages. For example, the hollow center volumes 510 may serve to reduce the overall weight of center core 500. In some embodiments the overall weight of the center core 500 may be reduced by about 25% to about 40%, or by at least 25%, or by at least 33% compared to known center cores. In some embodiments, the center core 500 may weigh about 150 lbs., or less than about 175 lbs. Additionally, in some embodiments, the pin core holes 560 may be utilized as attachment interfaces for machinery or users to grip the center core 500 while inserting the center core 500 into the mold 400. Further, in some embodiments, the one or more hollow center volumes 510 may allow for increased collapsibility of center core 500 as compared to conventional center cores. The increased collapsibility may provide for ease of removal of center core 500 after the fabrication of side frame 100 is completed. Additionally, the increased collapsibility of the core may reduce casting defects and improve the dimensional consistency of the finished side frame. As is well known, as the side frame casting cools it shrinks. The increased collapsibility may reduce the strain in the corners of the upper bolster opening and lower bolster opening. Additionally, the increased collapsibility may reduce the likelihood of hot tears which may increase the consistency of the side frame. Further, having a more consistent collapse in the bolster area, allows for more precise dimensional control and parallelism of the columns.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A center core for manufacturing a side frame of a rail car, where the side frame includes a bolster opening configured to receive an outboard end of a bolster, the center core comprising:

a first side wall having an inside surface and an outside surface;

a second side wall having an inside surface and an outside surface; a center column located between the first side wall and the second side wall;

a top wall having an inside surface and an outside surface; and a bottom wall having an inside surface and an outside surface;

wherein the outside surfaces of the first side wall, the second side wall, the top wall and the bottom wall define the bolster opening;

wherein the inside surfaces of the first side wall, the second side wall, the top wall and the bottom wall define at least one aperture; and wherein the first side wall includes at least one aperture configured to accept a pin core, and wherein the second side wall includes at least one aperture configured to accept a second pin core.

2. The center core of claim 1, wherein the center column is substantially parallel with the first side wall and with the second side wall.

3. The center core of claim 2, wherein the center column is substantially centered between the first side wall and the second side wall.

4. The center core of claim 1, wherein the first side wall includes two apertures configured to accept the first pin core and a third pin core, and wherein the second side wall includes two apertures configured to accept the second pin core and a fourth pin core.

5. A system for manufacturing a side frame of a rail car, where the side frame includes a bolster opening configured to receive an outboard end of a bolster, the system comprising:

a center core comprising:

a first side wall having an inside surface and an outside surface and having at least one aperture passing between the inside surface and the outside surface;

a second side wall having an inside surface and an outside surface and having at least one aperture passing between the inside surface and the outside surface; a center column located between the first side wall and the second side wall;

a top wall having an inside surface and an outside surface;

a bottom wall having an inside surface and an outside surface;

at least a first pin core configured to engage the at least one aperture in the first side wall; and at least a second pin core configured to engage the at least one aperture in the second side wall;

wherein the outside surfaces of the first side wall, the second side wall, the top wall and the bottom wall define the bolster opening; and wherein the inside surfaces of the first side wall, the second side wall, the top wall and the bottom wall define at least one hollow volume.

6. The system of claim 4, wherein each of the first and second pin cores are also engaged with a core adjacent to the center core.

7. The system of claim 6, wherein the center column is substantially parallel with the first side wall and with the second side wall.

8. The system of claim 7, wherein the center column is substantially centered between the first side wall and the second side wall.

9. The system of claim 6, further comprising:

a first aperture in the first side wall passing between the inside surface and the outside surface of the first side wall;

a second aperture in the first side wall passing between the inside surface and the outside surface of the first side wall;

a third aperture in the second side wall passing between the inside surface and the outside surface of the second side wall;

a fourth aperture in the second side wall passing between the inside surface and the outside surface of the second side wall;

a first pin core engaged with the first aperture;

a second pin core engaged with the second aperture a third pin core engaged with the third aperture; and a fourth pin core engaged with the fourth aperture.

10. The system of claim 6, wherein the first and second pin cores are substantially cylindrically shaped.

11. The system of claim 6, wherein the first and second pin cores each comprise:

a center core engagement portion configured to engage the center core;

a fastening hole portion configured to form a fastening hole in a finished side frame; and an adjacent core engagement portion configured to engage a core adjacent the center core.

12. The system of claim 11, wherein the center core engagement portion and the adjacent core engagement portion are substantially frustoconically shaped.

13. The system of claim 11, wherein the fastening hole portion is substantially cylindrically shaped.

14. The system of claim 6, wherein the first and second pin cores each comprise:

at least one alignment feature.

15. The system of claim 14, wherein the at least one alignment feature comprises:

a first side ridge;

a second side ridge; and a bottom ridge.

* * * * *